US006352028B1

(12) United States Patent
Ellis

(10) Patent No.: US 6,352,028 B1
(45) Date of Patent: Mar. 5, 2002

(54) WET LITHOGRAPHIC IMAGING WITH METAL-BASED PRINTING MEMBERS

(75) Inventor: Ernest W. Ellis, Harvard, MA (US)

(73) Assignee: Presstek, Inc., Hudson, NH (US)

( * ) Notice: Subject to any disclaimer, the term of this patent is extended or adjusted under 35 U.S.C. 154(b) by 0 days.

(21) Appl. No.: 09/512,572

(22) Filed: Feb. 24, 2000

(51) Int. Cl.[7] ..... B41C 1/10
(52) U.S. Cl. ..... 101/458; 101/467
(58) Field of Search ..... 101/454, 457, 101/458, 459, 463.1, 465–467, 478; 430/270.1, 302

(56) References Cited

U.S. PATENT DOCUMENTS

| | | | | | |
|---|---|---|---|---|---|
| 4,054,094 | A | * | 10/1977 | Caddell et al. | 101/467 |
| 4,063,949 | A | * | 12/1977 | Uhlig et al. | 430/300 |
| 4,214,249 | A | | 7/1980 | Kasai et al. | 346/135.1 |
| 4,693,958 | A | * | 9/1987 | Schwartz et al. | 430/302 |
| 4,731,317 | A | | 3/1988 | Fromson et al. | 430/159 |
| 5,372,907 | A | * | 12/1994 | Haley et al. | 430/302 |
| 5,466,557 | A | * | 11/1995 | Haley et al. | 430/302 |
| 5,493,971 | A | * | 2/1996 | Lewis et al. | 101/454 |
| 5,512,418 | A | * | 4/1996 | Ma | 430/271.1 |
| 5,674,658 | A | * | 10/1997 | Burberry et al. | 430/302 |
| 5,695,908 | A | * | 12/1997 | Furukawa | 101/466 |
| 5,783,364 | A | * | 7/1998 | Ellis et al. | 101/467 |
| 5,786,128 | A | * | 7/1998 | Vermeersch et al. | 101/467 |
| 5,829,353 | A | * | 11/1998 | Ellis | 101/465 |
| 5,925,496 | A | * | 7/1999 | Ghosh et al. | 101/478 |
| 6,001,536 | A | * | 12/1999 | Vermeersch et al. | 101/457 |
| 6,030,750 | A | * | 2/2000 | Vermeersch et al. | 101/467 |
| 6,136,503 | A | * | 10/2000 | Zheng et al. | 101/467 |
| 6,145,565 | A | * | 11/2000 | Fromson et al. | 101/463.1 |

FOREIGN PATENT DOCUMENTS

| | | | |
|---|---|---|---|
| EP | 770495 | * | 5/1997 |

* cited by examiner

*Primary Examiner*—Stephen R. Funk
(74) *Attorney, Agent, or Firm*—Testa, Hurwitz & Thibeault, LLP

(57) ABSTRACT

Lithographic printing is performed with printing members having a hydrophilic-surfaced metal support and a polymeric layer thereover. The polymeric layer absorbs imaging radiation and is soluble in a liquid to which ink will not adhere (e.g., fountain solution). Ordinarily, the polymeric layer is mostly removable by fountain solution. In response to absorbed imaging radiation, however, it may become permanently bound to the metal support so as to resist removal, serving as an ink-carrying oleophilic layer during printing.

10 Claims, 1 Drawing Sheet

WET LITHOGRAPHIC IMAGING WITH METAL-BASED PRINTING MEMBERS

FIELD OF THE INVENTION

The present invention relates to digital printing apparatus and methods, and more particularly to imaging of lithographic printing-plate constructions on- or off-press using digitally controlled laser output.

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas.

To circumvent the cumbersome photographic development, plate-mounting and plate-registration operations that typify traditional printing technologies, practitioners have developed electronic alternatives that store the imagewise pattern in digital form and impress the pattern directly onto the plate. Plate-imaging devices amenable to computer control include various forms of lasers.

Most computer-to-plate systems, particularly those that rely on laser exposure, do not utilize traditional metal-based plates. Such plates remain the standard for most of the long-run printing industry due to their durability and ease of manufacture, utilizing a heavy, metal base with a textured (e.g., grained and/or anodized) hydrophilic surface. But that surface, while durable in the context of printing, is nonetheless vulnerable to heat damage; if the texture is disrupted or smoothed, the plate will no longer adsorb fountain solution and therefore cannot function lithographically.

One approach toward adapting traditional metal-based plates to laser imaging is disclosed in U.S. Pat. No. 5,493,971. A lithographic printing construction in accordance with this patent includes a grained-metal substrate, a protective layer that can also serve as an adhesion-promoting primer, and an ablatable oleophilic surface layer. In operation, imagewise pulses from an imaging laser (typically emitting in the near-infrared, or "IR" spectral region) interact with the surface layer, causing ablation thereof and, probably, inflicting some damage to the underlying protective layer as well. The imaged plate may then be subjected to a solvent that eliminates the exposed protective layer, but which does no damage either to the surface layer or the unexposed protective layer lying thereunder. By using the laser to directly reveal only the protective layer and not the hydrophilic metal layer, the surface structure of the latter is fully preserved; the action of the solvent does no damage to this structure.

A related approach is disclosed in published PCT Application Nos. US99/01321 and US99/01396. A printing member in accordance with this approach has a grained metal substrate, a hydrophilic layer thereover, an ablatable layer, and an oleophilic surface layer. The surface layer is transparent to imaging radiation, which is concentrated in the ablatable layer by virtue of that layer's intrinsic absorption characteristics and also due to the hydrophilic layer, which provides a thermal barrier that prevents heat loss into the metal substrate. As the plate is imaged, ablation debris is confined beneath the surface layer; and following imaging, those portions of the surface layer overlying imaged regions are readily removed. Because the hydrophilic layer survives the imaging process, it can serve the printing function normally performed by grained aluminum, namely, adsorption of fountain solution.

Both of these approaches involve "positive-working" or "positive-imaging" constructions in the sense that inherently ink-receptive areas receive laser output and are ultimately removed, revealing the hydrophilic layer that will reject ink during printing; in other words, the "image area" is selectively removed to reveal the "background." Such plates, also referred to as "indirect-write," require substantial amounts of exposure, since in most printing jobs the background area greatly exceeds that of the image. This may tax certain types of imaging systems. Indeed, all of these constructions rely on ablation—complete release of a layer by catastrophic overheating—as an imaging mechanism, which requires imaging equipment capable of high (and therefore potentially vulnerable) output power levels.

DESCRIPTION OF THE INVENTION

BRIEF SUMMARY OF THE INVENTION

The present invention provides "negative-working" or "negative-imaging" wet lithographic plates that obviate the need for ablation as an imaging mechanism. These combine the benefits of simple construction, the ability to utilize traditional metal base supports, and amenability to imaging with low-power lasers that need not impart ablation-inducing energy levels. In one embodiment, a lithographic printing member in accordance with the invention comprises a metal support having a hydrophilic surface, and a polymeric layer thereover that absorbs imaging radiation and is soluble in a liquid to which ink will not adhere (e.g., fountain solution). Ordinarily, the polymeric layer is removable by fountain solution. In response to absorbed imaging radiation, however, it becomes permanently bound to the metal support and resists removal, serving as an ink-carrying oleophilic layer during printing. In another embodiment, the entire polymeric layer is removed, but the effect of imaging is to transform the hydrophilic metal surface into a surface that is hydrophobic and oleophilic.

A conventional gum, combined with an absorber of imaging radiation (e.g., in pigment or dye form, or as a chromophore integral within the polymer matrix), may be utilized as the polymeric layer. Indeed, it has been found that the gum arabic traditionally used to protect textured lithographic aluminum from environmental damage may serve as the basis for a suitable polymer formulation. Gum arabic is a protective colloid and emulsifier that protects oxide surfaces against further oxidation.

The oleophilicity of the polymeric layer may be enhanced by addition of a metal such as copper, either as an additive within the polymer matrix or, more desirably, as a very thin layer thereover. In the latter case, the heat produced by imaging of the polymeric layer causes the metal to integrate into the fused matrix, imparting oleophilicity thereto.

Because the plates of the present invention are "negative-working," only the areas that will ultimately accept ink receive laser output, so stress on the imaging equipment is minimized; and because the exposed layer is at most anchored (rather than being removed), overall power requirements may be less than those of ablation systems.

It should be stressed that, as used herein, the term "plate" or "member" refers to any type of printing member or surface capable of recording an image defined by regions exhibiting differential affinities for ink and/or fountain solution; suitable configurations include the traditional planar or curved lithographic plates that are mounted on the plate cylinder of a printing press, but can also include seamless cylinders (e.g., the roll surface of a plate cylinder), an endless belt, or other arrangement.

Furthermore, the term "hydrophilic" is used in the printing sense to connote a surface affinity for a fluid which prevents ink from adhering thereto. Such fluids include water for conventional ink systems, aqueous and non-aqueous dampening liquids, and the non-ink phase of single-fluid ink systems. Thus, a hydrophilic surface in accordance herewith exhibits preferential affinity for any of these materials relative to oil-based materials.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
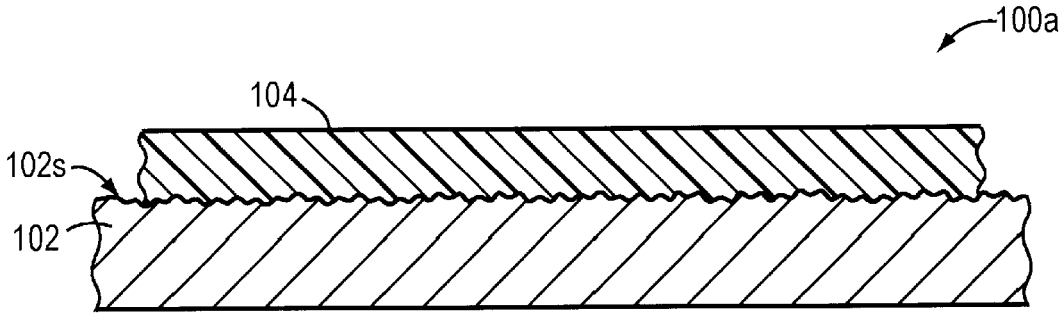
FIGS. 1 and 2 are enlarged sectional views of printing members in accordance with the present invention. It is noted that the drawings and elements thereof may not be drawn to scale.

Imaging apparatus suitable for use in conjunction with the present printing members includes at least one laser device that emits in the region of maximum plate responsiveness, i.e., whose $\lambda_{max}$ closely approximates the wavelength region where the plate absorbs most strongly. Specifications for lasers that emit in the near-IR region are fully described in, for example, U.S. Pat. Nos. Re. 35,512, 5,385,092, 5,822,345, and 5,990,925 (the entire disclosures of which are hereby incorporated by reference); lasers emitting in other regions of the electromagnetic spectrum are well-known to those skilled in the art.

Suitable imaging configurations are also set forth in detail in the above-noted patents. Briefly, laser output can be provided directly to the plate surface via lenses or other beam-guiding components, or transmitted to the surface of a blank printing plate from a remotely sited laser using a fiber-optic cable. A controller and associated positioning hardware maintain the beam output at a precise orientation with respect to the plate surface, scan the output over the surface, and activate the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor ("RIP") or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, it is generally preferable (for on-press applications) to employ a plurality of lasers and guide their outputs to a single writing array. The writing array is then indexed, after completion of each pass across or along the plate, a distance determined by the number of beams emanating from the array, and by the desired resolution (i.e., the number of image points per unit length). Off-press applications, which can be designed to accommodate very rapid scanning (e.g., through use of high-speed motors, mirrors, etc.) and thereby achieve high laser pulse rates, can frequently utilize a single laser as an imaging source.

With reference to FIG. 1, a representative embodiment of a lithographic printing member in accordance herewith is shown at 100*a*, and includes a metal substrate 102 and a polymeric layer 104 thereover. The primary functions of substrate 102 are to accept fountain solution during printing and to provide dimensionally stable mechanical support. Suitable substrate materials include, but are not limited to, aluminum, zinc, steel, and chromium. Preferred thicknesses range from 0.004 to 0.02 inch, with thicknesses in the range 0.005–0.012 inch being particularly preferred.

In general, metal layers must undergo special treatment in order to be capable of accepting fountain solution in a printing environment. Any number of chemical or electrical techniques, in some cases assisted by the use of fine abrasives to roughen the surface, may be employed for this purpose. For example, electrograining involves immersion of two opposed aluminum plates (or one plate and a suitable counterelectrode) in an electrolytic cell and passing alternating current between them. The result of this process is a finely pitted surface topography that readily adsorbs water. See, e.g., U.S. Pat. No. 4,087,341.

A structured or grained surface can also be produced by controlled oxidation, a process commonly called "anodizing." An anodized aluminum substrate consists of an unmodified base layer and a porous, "anodic" aluminum oxide coating thereover; this coating readily accepts water. However, without further treatment, the oxide coating would lose wettability due to further chemical reaction. Anodized plates are, therefore, typically exposed to a silicate solution or other suitable (e.g., phosphate) reagent that stabilizes the hydrophilic character of the plate surface. In the case of silicate treatment, the surface may assume the properties of a molecular sieve with a high affinity for molecules of a definite size and shape—including, most importantly, water molecules. The treated surface also promotes adhesion to an overlying photopolymer layer. Anodizing and silicate treatment processes are described in U.S. Pat. Nos. 3,181,461 and 3,902,976.

Preferred hydrophilic substrate materials include aluminum that has been mechanically, chemically, and/or electrically grained with or without subsequent anodization. In addition, some metal layers need only be cleaned, or cleaned and anodized, to present a sufficiently hydrophilic surface.

Polymeric layer 104 adheres to substrate 102 upon application, but, if unmodified, is mostly dissolved in and washed away by water, fountain solution, the aqueous phase of a single-fluid ink, or other liquid to which ink will not adhere. Layer 104 also absorbs imaging radiation and, in response thereto, adheres permanently to substrate 102. Mechanistically, this can occur in various ways. Most simply, the heat of radiation absorption may liquefy the polymer so that it soaks into the texture 102*s* of the hydrophilic substrate surface, becoming mechanically bound thereto as the polymer resolidifies. Alternatively or in addition, the heat may carbonize the polymer, removing or altering solubilizing chemical groups to defeat solubility. Alternatively or in addition, heat may cause physical transformation of the substrate 102 itself, altering its lithographic affinity from hydrophilicity to hydrophobicity and oleophilicity. This may occur, for example, through loss of texture; smooth aluminum will accept ink and repel water.

A preferred class of polymer is water-soluble gums, which may be natural or synthetic. In particular, combined with a suitable absorber of imaging radiation, the gum arabic traditionally used to protect textured lithographic aluminum from environmental damage may serve advantageously. An exemplary material for this purpose is the FSG finishing and storage gum supplied by Prisco (Newark, N.J.). This gum is combined with an absorber in pigment and/or dye form. For example, in the case of near-IR absorption, suitable pigments and dyes are described in the '512 and '092 patents; exemplary pigments include the CYASORB materials distributed, for example, by Glendale Protective Technologies, Lakeland, Fla. Dyes such as phthalocyanine or naphthalocyanine may be preferred for ease of dispersibility.

Following dispersion of the absorbing component into the polymer, the latter may be coated onto substrate 102 using any suitable method (roll, wire-wound rod, etc.). Conventional gum thicknesses are generally appropriate, although application weights for particular plate versions are straightforwardly determined (with reference to the sensitizer loading level, laser power, and imaging speed).

Figure 2:
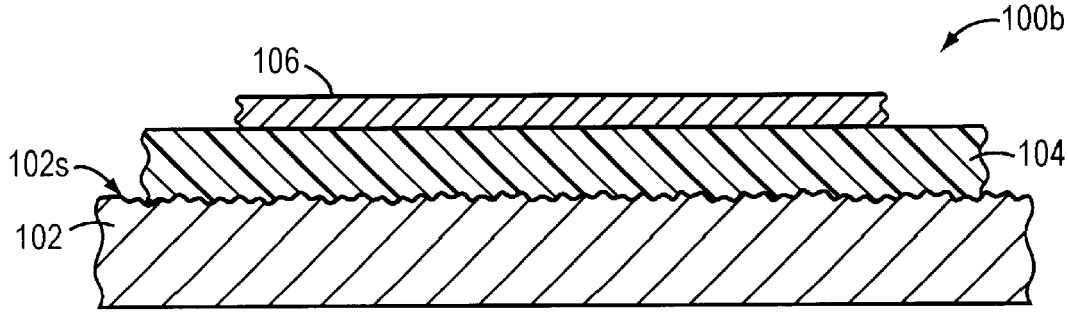

It may also be desirable to disperse within layer 104 a material that will enhance oleophilicity. For example, copper can be admixed into the gum as a powder. Alternatively, as shown in the embodiment 100*b* illustrated in FIG. 2, a thin layer 106—on the order of 3–100 Å, and preferably about 50 Å— of copper is deposited onto layer 104. The heat created by imaging causes the copper to integrate into the fused polymer and/or the surface 102*s* of substrate 102, enhancing oleophilicity of the polymer 104 (if it is retained) or of the substrate surface 102*s* (if the exposed polymer is removed). Copper absorbs near-IR radiation, so in imaging systems utilizing this wavelength band, layer 104 will itself assist in accumulating the heat that causes its integration.

Layer 104 is desirably applied under vacuum conditions (generally on the order of $3\times10^{-6}$ torr) by a deposition process such as DC sputtering or vacuum evaporation.

It will therefore be seen that the foregoing techniques provide a basis for improved lithographic printing and superior plate constructions. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of imaging a lithographic printing member, the method comprising the steps of:

a. providing a printing member having (i) a metal layer having a hydrophilic surface, (ii) a polymeric second layer disposed on the hydrophilic surface, the second layer absorbing imaging radiation and being soluble in a liquid to which ink will not adhere, and (iii) a thin absorptive metal layer over the polymeric layer, the metal layer absorbing imaging radiation to heat the underlying polymeric layer;

b. selectively exposing the printing member to imaging radiation in an imagewise pattern; and c. subjecting the exposed printing member to the liquid, thereby removing at least those portions of the second layer that have not received imaging radiation, the printing member being oleophilic where exposed.

2. The method of claim 1 wherein exposure of the absorptive metal layer to imaging radiation causes it to at least partially integrate within the polymeric layer.

3. The method of claim 2 wherein the absorptive metal layer imparts oleophilicity to the polymeric layer.

4. The method of claim 3 wherein the absorptive metal comprises copper.

5. The method of claim 1 wherein the polymeric layer comprises a gum.

6. A lithographic printing member comprising:

a. a metal layer having a hydrophilic surface;

b. a second layer disposed on the hydrophilic surface; and c. thereover, a thin absorptive metal layer, absorption of imaging radiation by the metal layer heating the underlying second layer, the second layer (i) absorbing imaging radiation and being soluble in a liquid to which ink will not adhere, (ii) responding to absorbed imaging radiation by resisting removal from the hydrophilic surface by the liquid, and (iii) being oleophilic where exposed.

7. The member of claim 6 wherein exposure of the absorptive metal layer to imaging radiation causes it to at least partially integrate within the polymeric layer.

8. The member of claim 7 wherein the absorptive metal layer imparts oleophilicity to the polymeric layer.

9. The member of claim 8 wherein the absorptive metal comprises copper.

10. The member of claim 6 wherein the polymeric layer comprises a gum.

* * * * *